US007080794B2

(12) United States Patent
Baumann et al.

(10) Patent No.: US 7,080,794 B2
(45) Date of Patent: Jul. 25, 2006

(54) ROTARY ATOMIZER WITH BLOCKABLE SHAFT

(75) Inventors: Michael Baumann, Flein (DE); Harry Krumma, Bönnigheim (DE)

(73) Assignee: Dürr Systems, Inc., Plymouth, MI (US)

( * ) Notice: Subject to any disclaimer, the term of this patent is extended or adjusted under 35 U.S.C. 154(b) by 242 days.

(21) Appl. No.: 10/781,596

(22) Filed: Feb. 18, 2004

(65) Prior Publication Data

US 2005/0001057 A1 Jan. 6, 2005

Related U.S. Application Data

(63) Continuation-in-part of application No. 10/256,428, filed on Sep. 27, 2002, now abandoned.

(51) Int. Cl.

| | |
|---|---|
| ***B05B 3/00*** | (2006.01) |
| ***B05B 3/04*** | (2006.01) |
| ***B05B 3/10*** | (2006.01) |
| ***F23D 11/04*** | (2006.01) |

(52) U.S. Cl. ..... 239/223; 239/225.1; 239/240

(58) Field of Classification Search ..... 239/223, 239/225.1, 240, 224, 231, 232, 252, 700–708, 239/DIG. 14; 92/165 PR, 15

See application file for complete search history.

(56) References Cited

U.S. PATENT DOCUMENTS

| | | | | |
|---|---|---|---|---|
| 4,896,834 | A * | 1/1990 | Coeling et al. | 239/691 |
| 4,927,081 | A * | 5/1990 | Kwok et al. | 239/223 |
| 5,538,189 | A * | 7/1996 | Rodgers | 239/587.5 |
| 5,816,508 | A | 10/1998 | Hollstein et al. | |
| 5,862,988 | A | 1/1999 | Van der Steur | |
| 6,105,886 | A | 8/2000 | Hollstein et al. | |
| 6,284,047 | B1 * | 9/2001 | Yoshida et al. | 118/629 |

FOREIGN PATENT DOCUMENTS

| | | |
|---|---|---|
| DE | 3912700 | 10/1990 |
| WO | WO/9636438 | 11/1996 |

* cited by examiner

*Primary Examiner*—David A. Scherbel
*Assistant Examiner*—Darren Gorman
(74) *Attorney, Agent, or Firm*—Howard & Howard

(57) ABSTRACT

A turbine assembly for use with a rotary atomizer rotates an atomizer bell for atomizing paint. A turbine housing is disposed within the rotary atomizer. A locking element is received by the turbine housing. A rotary shaft is rotatably supported within the turbine housing and has a distal end adapted to receive the atomizer bell. The distal end extends outwardly from the turbine housing. The rotary shaft has a proximal end adapted to receive the locking element. The locking element is moveable between a neutral position and a locking position for locking the rotary shaft in a non-rotatable position.

19 Claims, 4 Drawing Sheets

ROTARY ATOMIZER WITH BLOCKABLE SHAFT

CROSS-REFERENCE TO RELATED APPLICATIONS

This application is a continuation-in-part of and claims the benefit of U.S. patent application Ser. No. 10/256,428, filed Sep. 27, 2002 now abandoned.

FIELD OF THE INVENTION

The present invention relates generally toward a rotary atomizer, and more particularly toward a rotary atomizer for a coating device.

BACKGROUND OF THE INVENTION

In production paint settings, paint is applied to a workpiece using a rotary atomizer having an atomizer bell that spins at high speeds to atomize the paint being applied to the workpiece. This type of paint application device, in combination with generating an electrostatic field, has produced high quality paint finishes along with high paint transfer efficiencies. Generally, an atomizer bell is affixed to a rotating shaft that transfers rotational movement at high speed to the atomizer bell. A shaft receives rotational movement from a turbine or equivalent motor transferred through gears as is known in U.S. Pat. No. 5,816,508.

The rotating shaft and related drive mechanisms are generally concealed inside an atomizer housing where the shaft includes a distal end extending outwardly onto which the atomizer bell is affixed. As part of general production maintenance, the atomizer bell is typically removed from the assembly for cleaning or replacement with a new atomizer bell. This has generally been difficult to perform because the rotating shaft does not allow for the easy removal of the atomizer bell from the assembly.

U.S. Pat. No. 5,816,508 discloses one method of securing a rotatable shaft by affixing a push pin locking device to the housing of the atomizer. However, the drive mechanism of the disclosed rotary atomizer is quite complex requiring several gears to translate rotational movement to the atomizer bell. Therefore, it would be desirable to provide a compact simplified turbine design eliminating gear mechanisms while still providing the ability to lock the rotating shaft for easy removal of the atomizer bell.

SUMMARY OF THE INVENTION

A rotary atomizer assembly for applying paint to a workpiece includes a housing and an atomizer bell extending from the housing for atomizing paint being applied to the workpiece. A turbine is disposed within the housing and provides a bearing surface for a rotary shaft that the atomizer bell is affixed to. The rotary shaft is rotatably supported by the bearing surface and is coaxially aligned with the turbine. The shaft defines a distal end adapted to receive the atomizer bell and a proximal end adapted to be received by the turbine. A locking element is received by the turbine and extends through the housing. The locking element is moveable radially inwardly toward the rotary shaft and is engageable with the rotary shaft for locking the rotary shaft in a non-rotatable position.

The simplified design of the turbine and rotary shaft solves the problems associated with prior art rotary atomizer assemblies, which require independent gear mechanisms to drive the rotary shaft. The elimination of the gearing mechanisms reduces significantly the number of components necessary to rotate the atomizer bell at a high speed. Furthermore, a locking element now is capable of locking the rotary shaft to the turbine, which provides rotational movement to the rotary shaft enabling the atomizer bell to be easily removed from the assembly.

DETAILED DESCRIPTION OF THE PREFERRED EMBODIMENT

Figure 1:
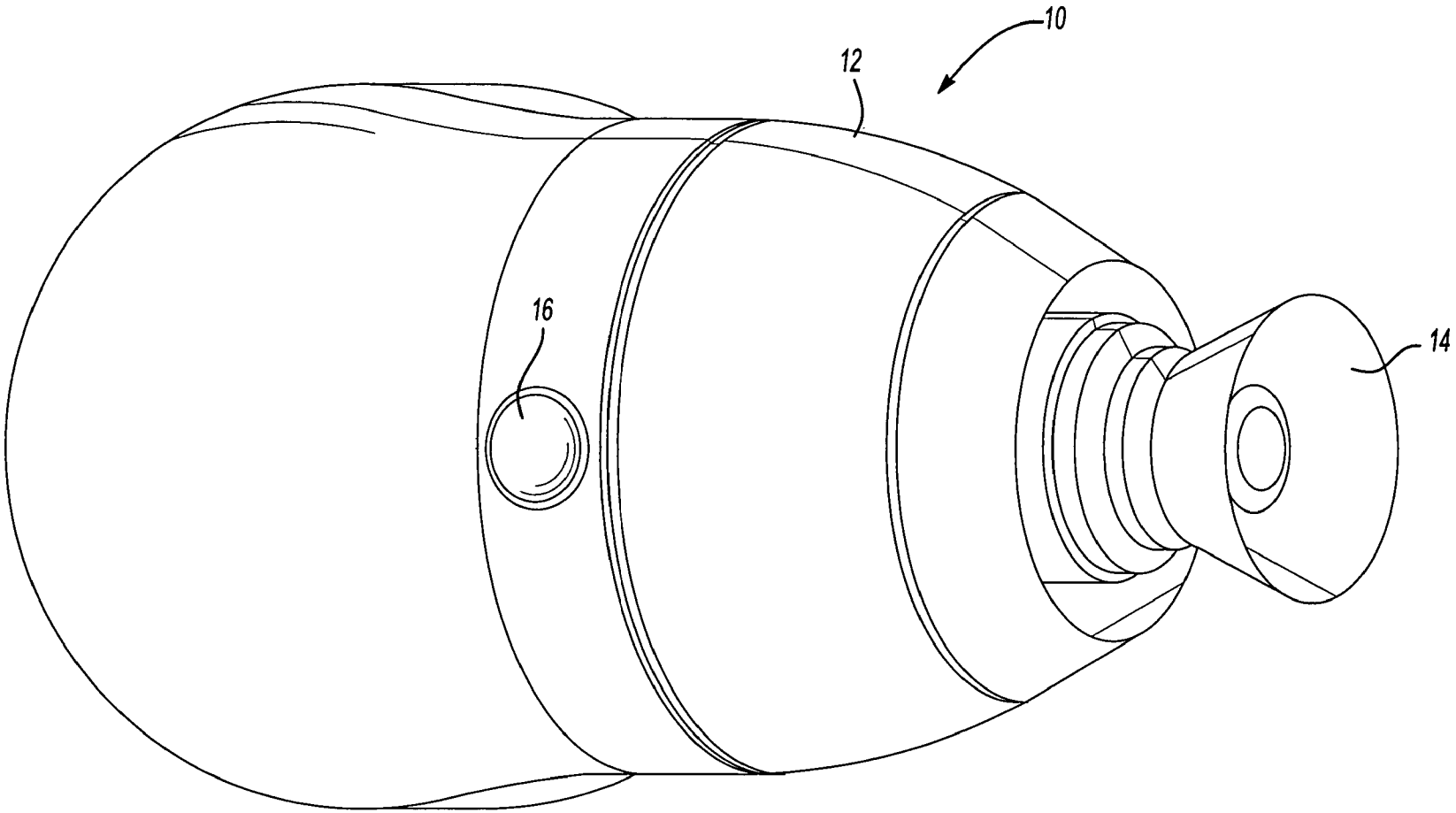
FIG. 1 shows a rotary atomizer assembly of the present invention.
Figure 2:
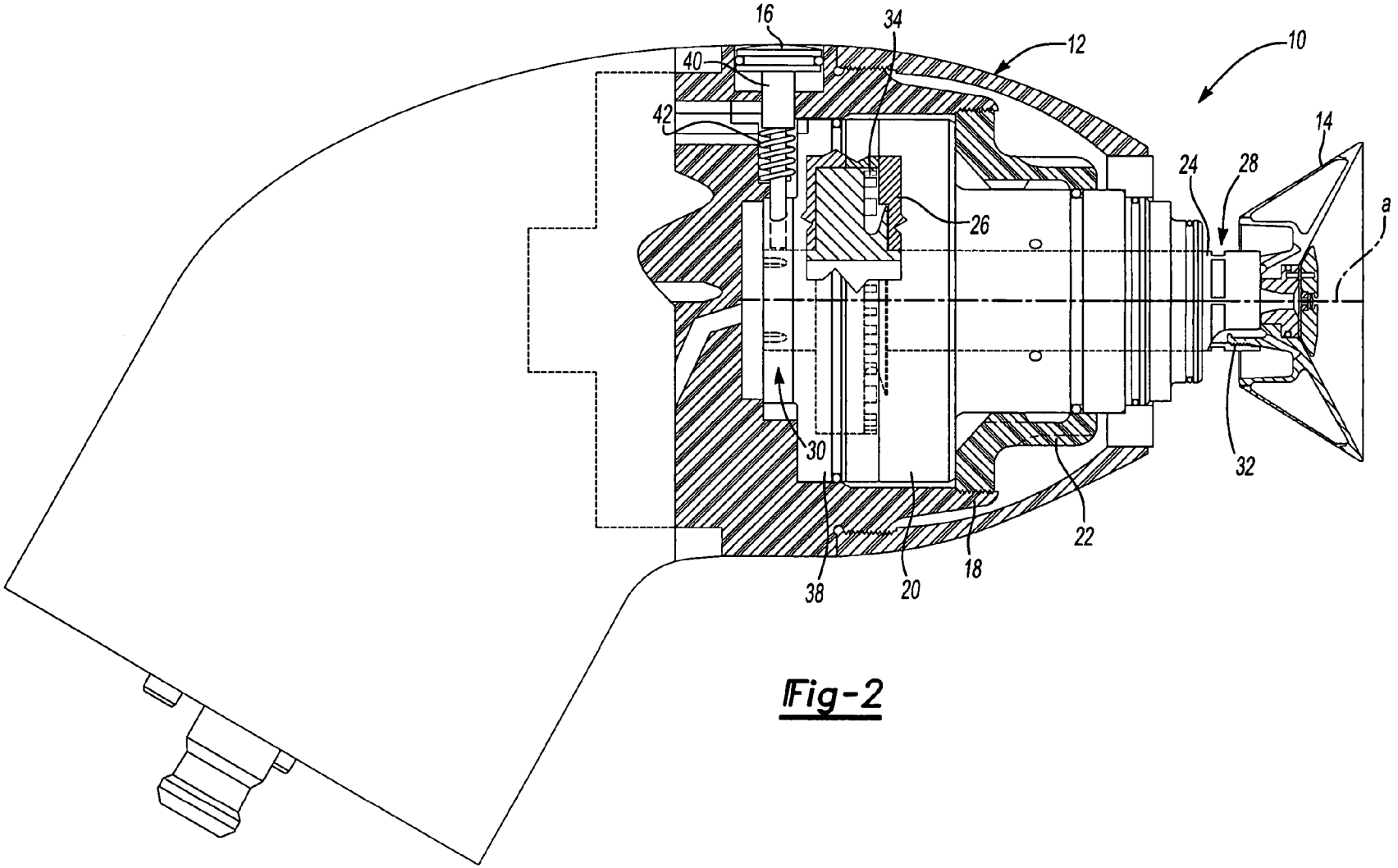
FIG. 2 shows a partial sectional view of the rotary atomizer of the present invention.
Figure 3:
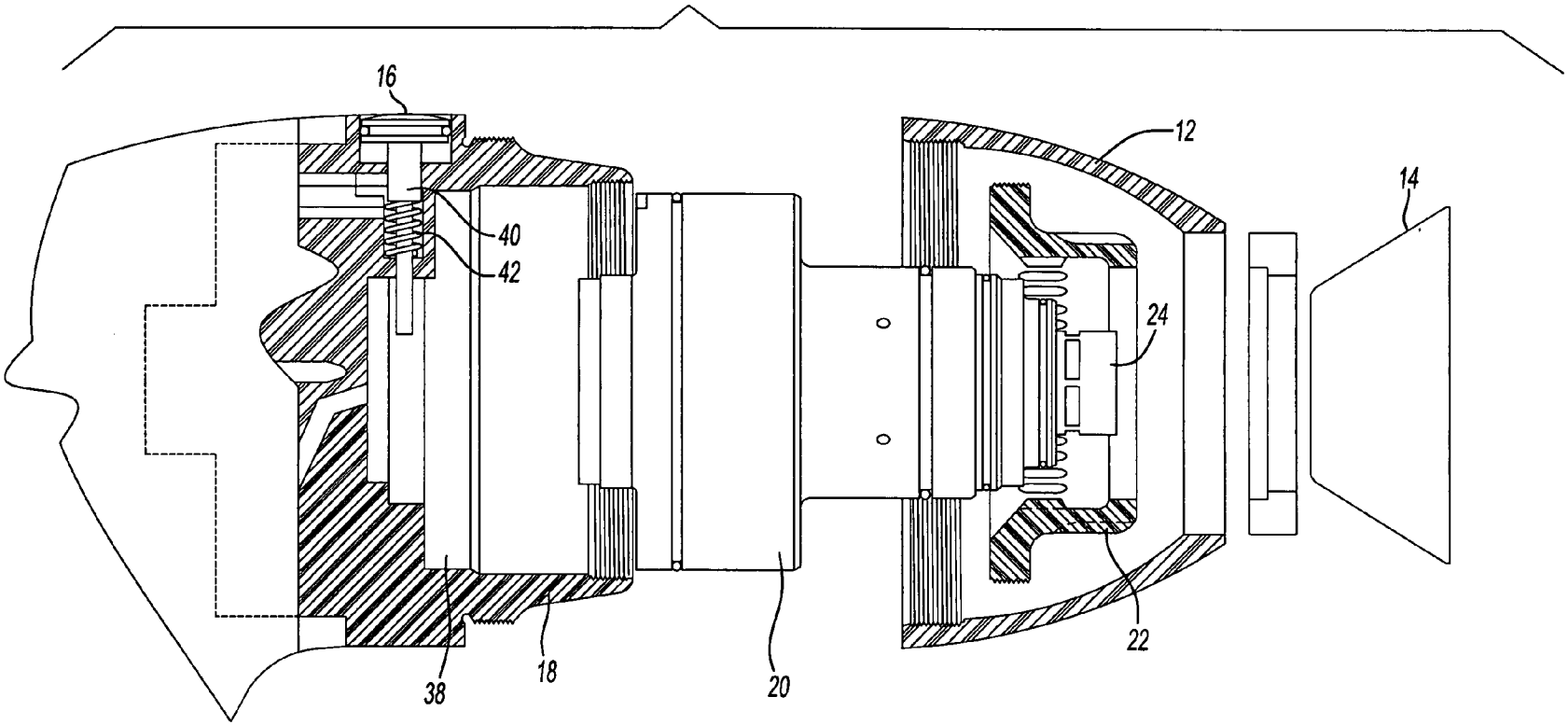
FIG. 3 shows an exploded view of the rotary atomizer of the present invention.

FIG. 1 shows a perspective view of the inventive atomizer assembly generally shown at 10. A housing 12 encloses the working components of the assembly 10 to protect the components from contaminants such as, for example, cleaning solvents and atomized paint. An atomizer bell 14 extends from the housing 12 and rotates at a high speed to atomize paint as will be explained further below. A button 16 is disposed in the housing 12 and provides a depression surface, the purpose of which will also be explained further below. Referring now to FIG. 2, a mounting member 18 is disposed inside the housing 12 and provides a mounting surface into which a turbine 20 is received. A retainer 22 is threaded onto the mounting member 18 over the turbine 20 to secure the turbine 20 inside the housing 12. A rotary shaft 24 is rotatably supported within the turbine 20 on bearing surface 26.

The rotary shaft 24 is coaxially aligned within the turbine 20 along axis A. The rotary shaft 24 includes a distal end 28 and a proximal end 30. The distal end 28 is adapted to receive the atomizer bell 14 in a fixed relationship. More specifically, the rotary shaft 24 defines a threaded surface 32 onto which the atomizer bell 14 is threadably received securing the atomizer bell 14 to the rotary shaft 24.

Turbine blades 34 circumscribe the rotary shaft 24 proximate the proximal end 30 of the rotary shaft 24. The turbine 20 defines an aperture 36, best shown in FIG. 4, fluidly cooperable with the turbine blades 34 to provide rotational movement to the rotary shaft 24 as is known to those of skill in the art of turbine motors. More than one aperture 36 may be included to provide varying degrees of rotational movement to the rotary shaft 24. The turbine blades 34 are completely concealed inside the turbine 20 by an end plate 38.

A locking element 40 is received by the turbine 20 for securing the rotary shaft 24 in a non-rotatable position. The locking element 40 is actuated by depressing the button 16 disposed in the housing 12, which moves the locking element 40 radially inwardly to engage the rotary shaft 24 and the end plate 38 of the turbine 20. A spring element 42 biases the locking element 40 radially outwardly from the axis A allowing the rotary shaft 24 to rotate freely inside the turbine 20.

Figure 4:
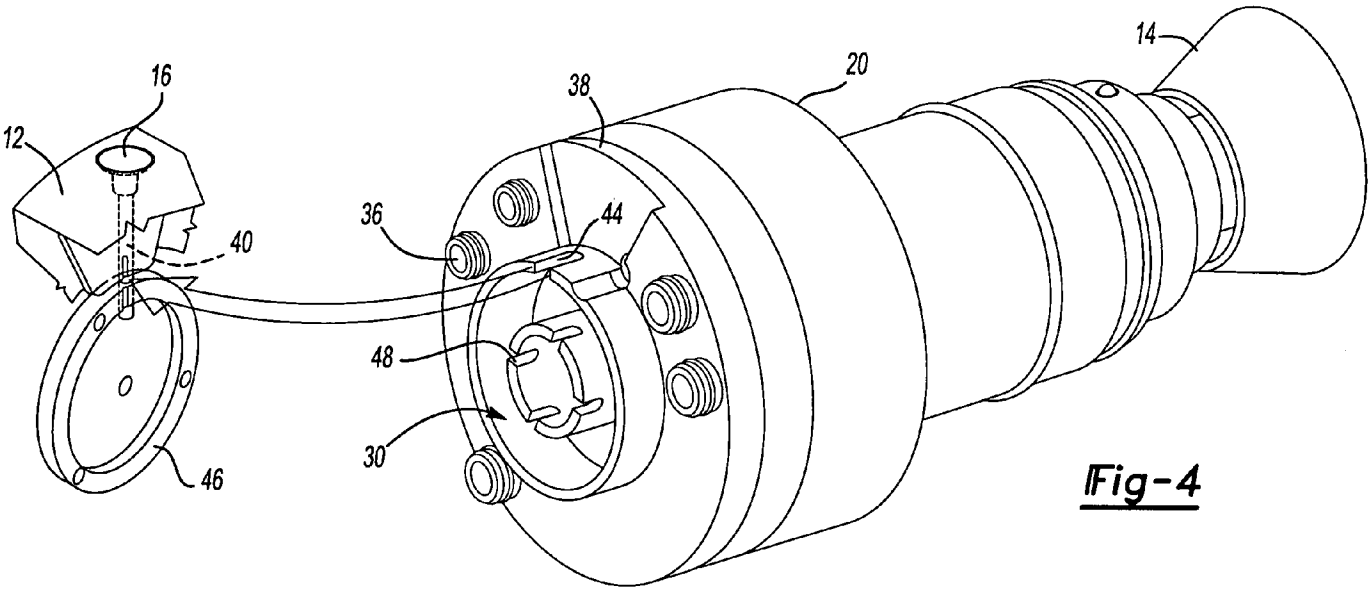
FIG. 4 shows a partial perspective view of the turbine associated with the rotary atomizer.

As best shown in FIG. 4, the end plate 38 of the turbine 20 defines a slot 44 with an end cap 46 through which the locking element 40 is slideably disposed. The proximal end 30 defines receptors 48 that receive the locking element 40 to secure the rotary shaft 24 in the non-rotatable position. The notch 44 disposed in the end plate 38 of the turbine 20 provides an abutment for the locking element 40 to secure the rotary shaft 24 in the non-rotatable position.

Figure 5C:
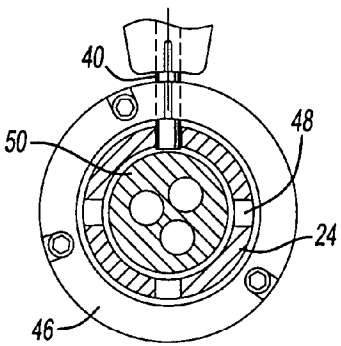
FIGS. 5A through 5C show a sequential movement of the locking element engaging the rotary shaft and the turbine.
Figure 5B:
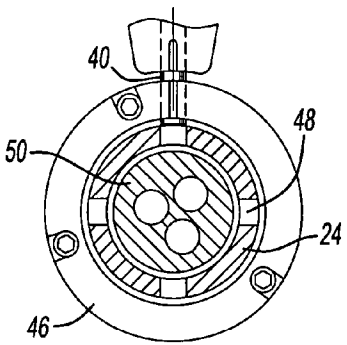
Figure 5A:
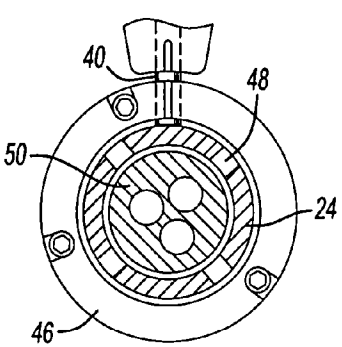

Referring to FIGS. 5A through 5C, the locking element 40 is shown in the neutral position (FIG. 5A) and the locking position (FIG. 5C). A cluster of feed lines 50 is concentrically disposed within the rotary shaft 24 for providing paint and cleaning fluids to the atomizer bell 14. However, the rotary shaft 24 rotates freely around the feed line cluster 50, which is immobile relative to the atomizer bell 14 and the rotary shaft 24. As shown in FIG. 5A, moving the locking element 40 radially inwardly does not engage the receptors disposed in the turbine 20 as the receptors 48 are not aligned with the locking element 40. As shown in FIG. 5B, by rotating the rotary shaft 24, the receptors 48 are easily aligned with the locking element 40 enabling the locking element to be moved from the neutral position as shown in FIG. 5A to the locking position as shown in FIG. 5C thereby preventing the rotary shaft 24 from rotating. Once the locking element 40 has been moved to the locking position, the atomizer bell 14 is easily removed by unscrewing the atomizer bell 14 from the rotary shaft 24.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A turbine assembly for use with a rotary atomizer having an atomizer bell for atomizing paint, comprising:

a turbine housing disposed within said rotary atomizer;

a locking element received by said turbine housing, a rotary shaft rotatably supported within said turbine housing and having a distal end adapted to receive the atomizer bell and extending outwardly from said turbine housing, and said rotary shaft having a proximal end adapted to receive said locking element; wherein said locking element is moveable between a neutral position and a locking position thereby locking said rotary shaft against said turbine housing in a non-rotatable position.

2. An assembly as set forth in claim 1, wherein said proximal end of said rotary shaft defines receptors adapted to receive said locking element.

3. An assembly as set forth in claim 2, wherein said receptors comprise notches disposed in said proximal end of said rotary atomizer.

4. An assembly as set forth in claim 1, wherein said locking element is biased in said neutral position.

5. An assembly as set forth in claim 1, wherein said turbine housing includes a cover plate disposed adjacent said proximal end of said rotary shaft.

6. An assembly as set forth in claim 5, wherein said cover plate defines a cover plate notch slidably receiving said locking element thereby providing an abutment surface for said locking element for securing said rotary shaft in a non-rotatable position.

7. An assembly as set forth in claim 6, wherein said distal end of said rotary shaft defines screw threads for receiving said atomizer bell.

8. An assembly as set forth in claim 1, wherein said rotary shaft includes turbine fan blades circumscribing said rotary shaft thereby providing rotational movement to said atomizer bell.

9. An assembly as set forth in claim 8, wherein said turbine housing defines an aperture fluidly connectable to a source of pressurized air and being cooperable with said fan blades thereby providing rotational movement to said rotary shaft.

10. A rotary atomizer assembly for applying paint to a workpiece, comprising:

an housing;

an atomizer bell extending from said housing;

a turbine disposed within said housing and providing bearing surface;

a rotary shaft rotatably supported by said bearing surface and coaxially aligned with said turbine, wherein said shaft defines a distal end adapted to receive said atomizer bell and a proximal end adapted to be driven by said turbine; and a locking element received by said turbine and extending through said housing, wherein said locking element is moveable radially inwardly toward said rotary shaft and is engageable with said rotary shaft thereby locking said rotary shaft to said turbine in a non-rotatable position.

11. An assembly as set forth in claim 10, wherein said proximal end of said rotary shaft defines receptors adapted to receive said locking element.

12. An assembly as set forth in claim 11, wherein said receptors comprise notches disposed in said proximal end of said rotary shaft.

13. An assembly as set forth in claim 10, wherein said locking element is biased in a radially outwardly direction from said rotary shaft.

14. An assembly as set forth in claim 10, wherein said locking element includes a depression surface disposed outside said housing.

15. An assembly as set forth in claim 10 wherein said turbine includes a cover plate disposed adjacent said proximal end of said rotary shaft.

16. An assembly as set forth in claim 10, wherein said cover plate defines a cover plate notch slidably receiving said locking element thereby providing an abutment surface for said locking element for securing said rotary shaft to said turbine in a non-rotatable position.

17. An assembly as set forth in claim 10, wherein said distal end of said rotary shaft defines screw threads for receiving said atomizer bell.

18. An assembly as set forth in claim 10, wherein said rotary shaft includes a turbine fan blades circumscribing said rotary shaft thereby providing rotational movement to said atomizer bell.

19. An assembly as set forth in claim 18, wherein said turbine defines an aperture fluidly connectable to a source of pressurized air and being cooperable with said fan blades thereby providing rotational movement to said rotary shaft.

* * * * *

UNITED STATES PATENT AND TRADEMARK OFFICE

CERTIFICATE OF CORRECTION

PATENT NO. : 7,080,794 B2
APPLICATION NO. : 10/781596
DATED : July 25, 2006
INVENTOR(S) : Michael Baumann and Harry Krumma It is certified that error appears in the above-identified patent and that said Letters Patent is hereby corrected as shown below:

In column 3, line 25, please insert --the-- before the word "atomizer."

In column 4, line 13, please insert --turbine-- before the word "fan."

In column 4, line 21, please insert --a-- before the word "bearing."

In column 4, line 57, please delete "a" before the word "turbine."

In column 4, line 61, please delete the word "housing" and insert the word --turbine--.

In column 4, line 62, please insert the word --turbine-- before the word "fan."

Signed and Sealed this

Second Day of January, 2007

JON W. DUDAS
*Director of the United States Patent and Trademark Office*